US009183959B2

(12) United States Patent
Bloomquist et al.

(10) Patent No.: US 9,183,959 B2
(45) Date of Patent: Nov. 10, 2015

(54) CABLE DRIVEN ISOTOPE DELIVERY SYSTEM

(75) Inventors: Bradley Bloomquist, Wilmington, NC (US); Jennifer M. Bowie, Leland, NC (US); Heather Hatton, Wilmington, NC (US); Nicholas R. Gilman, Broomfield, CO (US); William Earl Russell, II, Wilmington, NC (US); David Grey Smith, Leland, NC (US)

(73) Assignee: GE-HITACHI NUCLEAR ENERGY AMERICAS LLC, Wilmington, NC (US)

( * ) Notice: Subject to any disclaimer, the term of this patent is extended or adjusted under 35 U.S.C. 154(b) by 1533 days.

(21) Appl. No.: 12/547,249

(22) Filed: Aug. 25, 2009

(65) Prior Publication Data

US 2011/0051875 A1 Mar. 3, 2011

(51) Int. Cl.

| | |
|---|---|
| ***G21G 1/00*** | (2006.01) |
| ***G21C 19/20*** | (2006.01) |
| ***G21C 19/32*** | (2006.01) |
| ***G21G 1/02*** | (2006.01) |
| ***H05H 6/00*** | (2006.01) |

(52) U.S. Cl.

CPC ..... *G21G 1/0005* (2013.01); *G21C 19/20* (2013.01); *G21C 19/32* (2013.01); *G21G 1/02* (2013.01); *H05H 6/00* (2013.01)

(58) Field of Classification Search

USPC ..... 376/156, 202, 245, 249

See application file for complete search history.

(56) References Cited

U.S. PATENT DOCUMENTS

| | | | | |
|---|---|---|---|---|
| 3,594,275 | A | 7/1971 | Ransohoff at al. | |
| 3,879,612 | A * | 4/1975 | Foster et al. | 250/370.05 |
| 3,940,318 | A * | 2/1976 | Arino et al. | 205/48 |
| 3,998,691 | A | 12/1976 | Shikata et al. | |
| 4,196,047 | A | 4/1980 | Mitchem et al. | |
| 4,284,472 | A | 8/1981 | Pomares et al. | |

(Continued)

FOREIGN PATENT DOCUMENTS

| | | | |
|---|---|---|---|
| JP | 36-007990 | B | 6/1959 |
| JP | 2009-198500 | A | 9/2009 |

OTHER PUBLICATIONS

Swedish Office Action issued May 5, 2011 in connection with corresponding Swedish Patent Application No. 1050867-9 with unofficial English translation.

(Continued)

*Primary Examiner* — Jack W Keith
*Assistant Examiner* — Marshall O'Connor
(74) *Attorney, Agent, or Firm* — Harness, Dickey & Pierce, P.L.C.

(57) ABSTRACT

Provided is an isotope delivery system and a method for irradiating a target and delivering the target to an extraction point. The isotope delivery system may include a cable including at least one target for irradiation, a drive system configured for moving the cable, and a first guide configured to guide the cable for insertion and extraction from a nuclear reactor. The method for irradiating a target and delivering a target may include pushing a cable with an attached target through a first guide and into a nuclear reactor using a drive system, irradiating the target in the nuclear reactor, pulling the cable with the attached irradiated target towards the drive system, pushing the cable with the irradiated target towards a loading/unloading area using the drive system, and placing the irradiated target into a transfer cask, wherein the cable is pulled and pushed by the drive system.

16 Claims, 16 Drawing Sheets

(56) References Cited

U.S. PATENT DOCUMENTS

| | | | | |
|---|---|---|---|---|
| 4,462,956 | A | | 7/1984 | Boiron et al. |
| 4,475,948 | A | | 10/1984 | Cawley et al. |
| 4,493,813 | A | | 1/1985 | Loriot et al. |
| 4,532,102 | A | | 7/1985 | Cawley |
| 4,597,936 | A | | 7/1986 | Kaae |
| 4,617,985 | A | | 10/1986 | Triggs et al. |
| 4,663,111 | A | | 5/1987 | Kim et al. |
| 4,729,903 | A | | 3/1988 | McGovern et al. |
| 4,782,231 | A | | 11/1988 | Svoboda et al. |
| 4,859,431 | A | | 8/1989 | Ehrhardt |
| 5,053,186 | A | | 10/1991 | Vanderheyden et al. |
| 5,145,636 | A | | 9/1992 | Vanderhevden et al. |
| 5,355,394 | A | | 10/1994 | van Geel et al. |
| 5,400,375 | A | | 3/1995 | Suzuki et al. |
| 5,513,226 | A | | 4/1996 | Baxter et al. |
| 5,596,611 | A | | 1/1997 | Ball |
| 5,615,238 | A | | 3/1997 | Wiencek et al. |
| 5,633,900 | A | | 5/1997 | Hassal |
| 5,682,409 | A | | 10/1997 | Caine |
| 5,758,254 | A | | 5/1998 | Kawamura et al. |
| 5,867,546 | A | | 2/1999 | Hassal |
| 5,871,708 | A | | 2/1999 | Park et al. |
| 5,910,971 | A | * | 6/1999 | Ponomarev-Stepnoy et al. ..... 376/189 |
| 6,056,929 | A | | 5/2000 | Hassal |
| 6,160,862 | A | | 12/2000 | Wiencek et al. |
| 6,192,095 | B1 | | 2/2001 | Sekine et al. |
| 6,233,299 | B1 | | 5/2001 | Wakabayashi |
| 6,456,680 | B1 | | 9/2002 | Abalin et al. |
| 6,678,344 | B2 | | 1/2004 | O'Leary et al. |
| 6,751,280 | B2 | | 6/2004 | Mirzadeh et al. |
| 6,804,319 | B1 | | 10/2004 | Mirzadeh et al. |
| 6,895,064 | B2 | | 5/2005 | Ritter |
| 6,896,716 | B1 | | 5/2005 | Jones, Jr. |
| 7,157,061 | B2 | | 1/2007 | Meikrantz et al. |
| 7,235,216 | B2 | | 6/2007 | Kiselev et al. |
| 8,437,443 | B2 | | 5/2013 | Russell, II |
| 2002/0034275 | A1 | | 3/2002 | Abalin et al. |
| 2003/0012325 | A1 | | 1/2003 | Kernert et al. |
| 2003/0016775 | A1 | | 1/2003 | Jamriska, Sr. et al. |
| 2003/0103896 | A1 | | 6/2003 | Smith |
| 2003/0179844 | A1 | | 9/2003 | Filippone |
| 2004/0091421 | A1 | | 5/2004 | Aston et al. |
| 2004/0105520 | A1 | | 6/2004 | Carter |
| 2004/0196942 | A1 | | 10/2004 | Mirzadeh et al. |
| 2004/0196943 | A1 | | 10/2004 | Di Caprio |
| 2005/0105666 | A1 | | 5/2005 | Mirzadeh et al. |
| 2005/0118098 | A1 | | 6/2005 | Vincent et al. |
| 2006/0062342 | A1 | | 3/2006 | Gonzalez Lepera et al. |
| 2006/0126774 | A1 | | 6/2006 | Kim et al. |
| 2007/0133731 | A1 | | 6/2007 | Fawcett et al. |
| 2007/0133734 | A1 | | 6/2007 | Fawcett et al. |
| 2007/0297554 | A1 | | 12/2007 | Lavie et al. |
| 2008/0031811 | A1 | | 2/2008 | Ryu et al. |
| 2008/0076957 | A1 | | 3/2008 | Adelman |

OTHER PUBLICATIONS

Unofficial English Translation of Japanese Office Action issued in connection with corresponding JP Patent Application No. 2010-183523 dated on Aug. 26, 2014.

* cited by examiner

CABLE DRIVEN ISOTOPE DELIVERY SYSTEM

BACKGROUND

1. Field

Example embodiments relate to a cable driven isotope delivery system and a method of irradiating a target material using a nuclear power reactor.

2. Description of the Related Art

Technetium-99m (m is metastable) is a radionuclide used in nuclear medical diagnostic imaging. Technetium-99m is injected into a patient which, when used with certain specialized pieces of equipment, is used to image the patient's internal organs.

Molybdenum-99 may be produced by placing natural molybdenum metal or enriched molybdenum-98 into a core, which is then irradiated within a nuclear reactor's neutron flux. Molybdenum-98 absorbs a neutron during the irradiation process and becomes molybdenum-99 (Mo-99). Mo-99 is unstable and decays with a 66-hour half-life to technetium-99m (m is metastable). After the irradiation step, the irradiated molybdenum can be processed into a Titanium Molybdate chemistry and placed in a column for elution. Subsequently, saline is passed through the irradiated titanium molybdate to remove the technetium-99m ions from the irradiated titanium molybdate. However, technetium-99m has a halflife of only six (6) hours, therefore, readily available sources of technetium-99m are desired.

SUMMARY

Example embodiments provide a cable driven isotope delivery system and a method for delivering an irradiation target to the nuclear reactor's neutron flux and retrieving the target material.

In accordance with example embodiments, an isotope delivery system may include a cable including at least one target for irradiation, a drive system configured to move the cable, and a first guide configured to guide the cable to and from a nuclear reactor's core.

In accordance with example embodiments, a method for irradiating a target and delivering a target may include pushing and/or the retracting of a cable with an attached target through a first guide and into a nuclear reactor's neutron flux using a drive system, irradiating the target in the nuclear reactor, retracting the cable with the attached irradiated target towards the drive system, pushing the cable with the irradiated target towards a loading/unloading area using the drive system, and placing the irradiated target into a transfer cask, wherein the cable is pulled and pushed by the drive system.

BRIEF DESCRIPTION OF TIE DRAWINGS

Example embodiments will be more clearly understood from the following detailed description taken in conjunction with the accompanying drawings.

DETAILED DESCRIPTION

Figure 1:
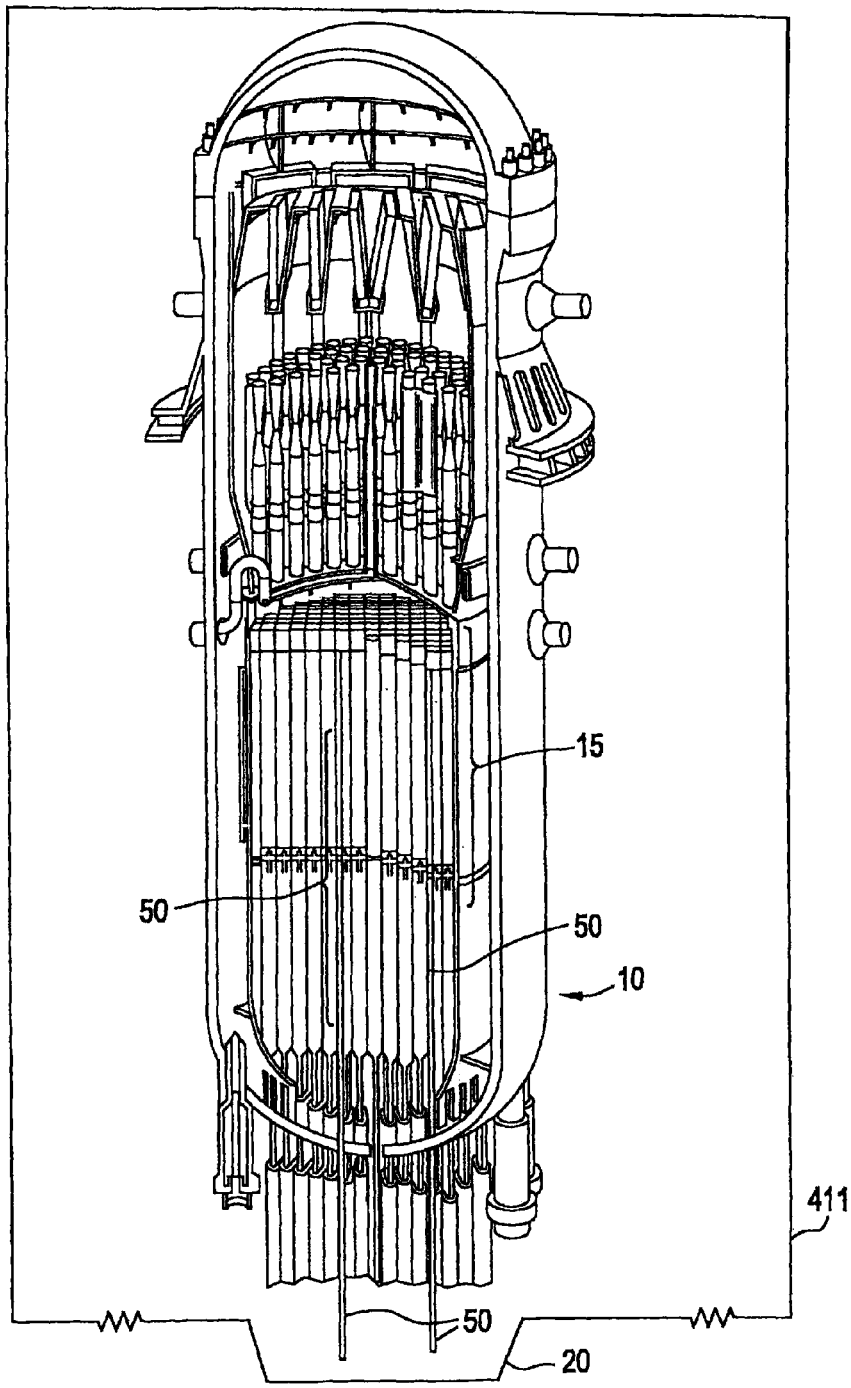
FIG. 1 CONVENTIONAL ART
FIG. 1 is a view of a conventional reactor pressure vessel.

Example embodiments will now be described more fully with reference to the accompanying drawings. Example embodiments may, however, be embodied in many different forms and should not be construed as being limited to the embodiments set forth herein; rather, example embodiments are provided so that this disclosure will be thorough and complete, and will fully convey the inventive concept to those skilled in the art. In the drawings, the thicknesses of layers and regions are exaggerated for clarity.

It will be understood that when a component, for example, a layer, a region, or a substrate is referred to as being "on", "connected to", or "coupled to" another component throughout the specification, it can be directly "on". "connected to", or "coupled to" the other component, or intervening layers that may be present. On the other hand, when a component is referred to as being "directly on", "directly connected to", or "directly coupled to" another component, it will be understood that no intervening layer is present. Like reference numerals denote like elements. As used in the present specification, the term "and/or" includes one of listed, corresponding items or combinations of at least one item.

In the present description, terms such as 'first'. 'second'. etc. are used to describe various members, components, regions, layers, and/or portions. However, it is obvious that the members, components, regions, layers, and/or portions should not be defined by these terms. The terms are used only for distinguishing one member, component, region, layer, or portion from another member, component, region, layer, or portion. Thus, a first member, component, region, layer, or portion which will be described may also refer to a second member, component, region, layer, or portion, without departing from the teaching of the present general inventive concept.

Relative terms, such as "under," "lower," "bottom," "on," "upper," and/or "top", may be used herein to describe one element's relationship to another element as illustrated in the figures. It will be understood that relative terms are intended to encompass different orientations of the device in addition to the orientation depicted in the figures. For example, if the device in the figures is turned over, elements described as being on the "upper" side of other elements would then be oriented on "lower" sides of the other elements. The exemplary term "upper", can therefore, encompass both an orientation of "lower" and "upper", depending of the particular orientation of the figure.

The terminology used herein is for the purpose of describing example embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

FIG. 1 is an illustration of a conventional reactor pressure vessel 10 usable with example embodiments and example methods. Reactor pressure vessel 10 may be used in at least a 100 MWe commercial light water nuclear reactor conventionally used for electricity generation throughout the world. Reactor pressure vessel 10 may be positioned within a containment structure 411 that serves to contain radioactivity in the case of an accident and prevent access to reactor's pressure vessel 10 during operation of the reactor's core 15. A cavity below the reactor's pressure vessel 10, known as a drywell 20, serves to house equipment servicing the vessel such as pumps, drains, instrumentation tubes, and/or control rod drives, etc. As shown in FIG. 1, at least one instrumentation tube 50 extends vertically into the reactor pressure vessel 10 and well into or through the reactor's core 15 containing nuclear fuel bundles and relatively high amounts of neutron flux during operation of the reactor's core 15. Instrumentation tubes 50 may be generally cylindrical and widen with height of the reactor pressure vessel 10; however, other instrumentation tube geometries are commonly encountered in the industry. An instrumentation tube 50 may have an inner diameter and/or clearance of approximately 0.3 inch in diameter, for example.

The instrumentation tubes 50 may terminate below the reactor's pressure vessel 10 in the drywell 20. Conventionally, instrumentation tubes 50 may permit neutron flux detectors, and other types of detectors, to be inserted therein through an opening at a lower end in the drywell 20. These detectors may extend up through instrumentation tubes 50 to monitor conditions in the reactor's core 15. Examples of conventional monitor types include wide range detectors (WRNM), source range monitors (SRM), intermediate range monitors (IRM), and/or Local Power Range Monitors (LPRM).

Figure 2:
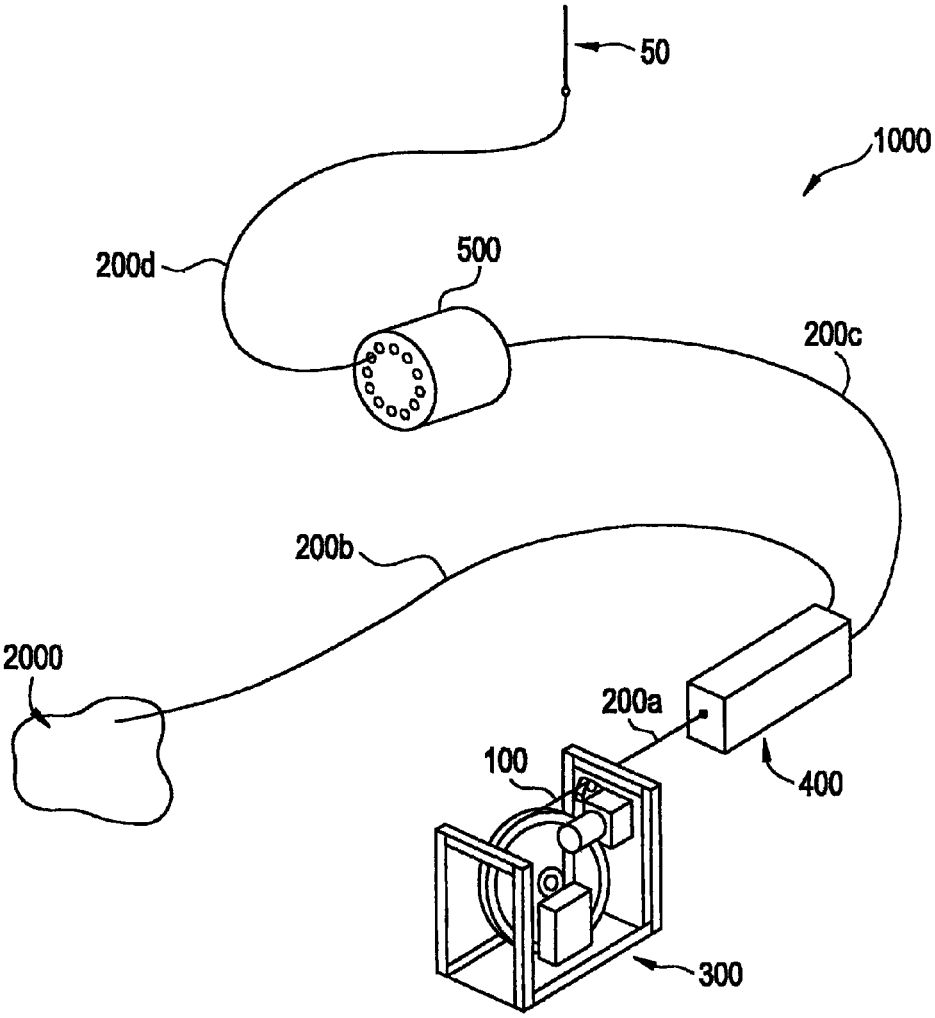
FIG. 2 is a view showing a cable driven isotope delivery system according to example embodiments.

FIG. 2 illustrates a first example embodiment of the cable driven isotope delivery system 1000 that may use the instrument tubes 50 to deliver an irradiation target into the reactor's pressure vessel 10. As will be shortly illustrated, the cable driven isotope delivery system 1000 may be capable of transferring an irradiation target from a loading/unloading area 2000, to an instrumentation tube 50 of the reactor pressure vessel 10, and from the instrumentation tube 50 of the reactor pressure vessel 10 to the loading/unloading area 2000. As shown in FIG. 2, the cable driven isotope delivery system 1000 may include a cable 100, tubing 200*a*, 200*b*, 200*c*, and 200*d*, a drive mechanism 300, a first guide 400, and a second guide 500. The tubing 200*a*, 200*b*, 200*c*, and 200*d* may be configured to allow the cable 100 to slide therein. Accordingly, the tubing 200*a*, 200*b*, 200*c*, and 200*d* may act as a stiffener to aid in guiding the cable 100 from one point in the cable driven isotope delivery system 1000 to another point in the cable driven isotope delivery system 1000.

Figure 3:
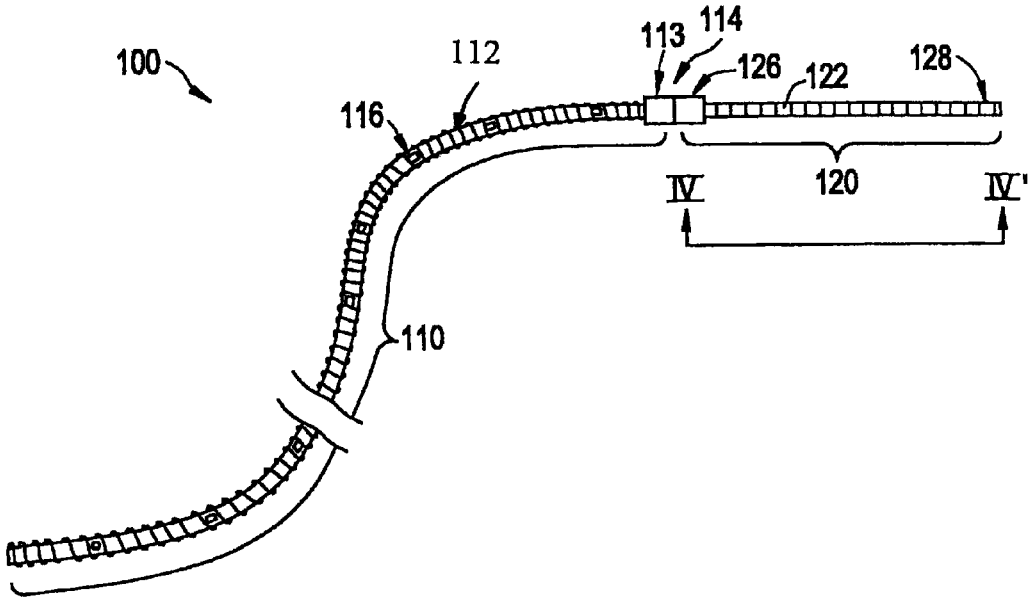
FIG. 3 is a partial view of a cable with connectors that are being used with a cable driven isotope system according to example embodiments.
Figure 4:
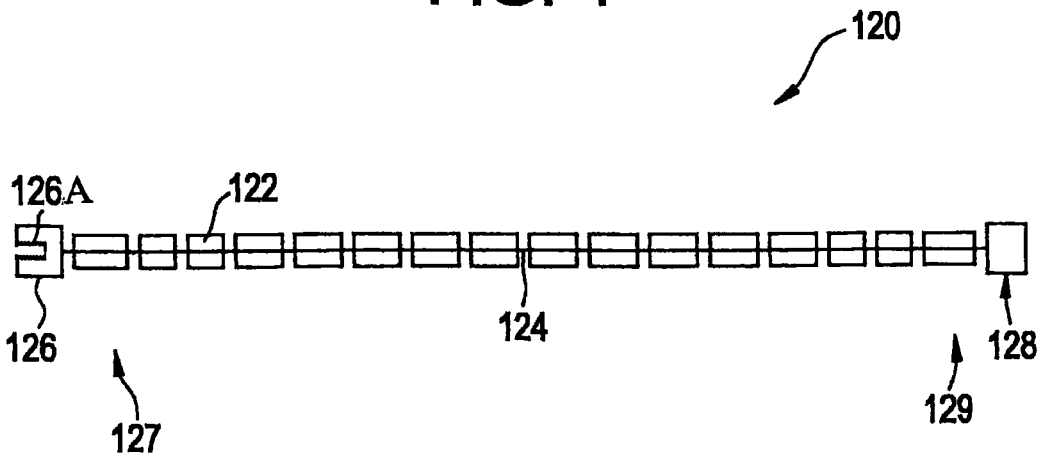
FIG. 4 is a close-up view of a target portion of the cable and end connectors according to example embodiments.

An example of the cable 100 is illustrated in FIGS. 3 and 4. The example cable 100 resembles a rope having two portions: 1) a relatively long driving portion 110; and 2) a target portion 120. The driving portion 110 of the cable 100 may be made from a material having a low nuclear cross-section such as aluminum, silicon, and/or stainless steel. The driving portion 110 of the cable 100 may be braided in order to increase the flexibility and stiffness and/or strength of the cable 100 so that the cable 100 may be easily bendable and capable of being wrapped around a reel, for example, the cable storage reel 320 of FIG. 6. Although the cable 100 may be easily bendable, the cable should be configured to be sufficiently stiff in an axial direction of the cable so that the cable 100 may be pushed and/or retracted through the aforementioned tubing 200*a*, 200*b*, 200*c*, and 200*d* without buckling.

The driving portion 110 of the cable 100 may include a helical winding 112 on the outside of the driving portion 110. As will be explained shortly, the helical winding 112 may be configured to cooperate with a helical gear 330 that may be present in the drive system 300 (see FIG. 6). However, the invention is not limited by the helical winding 112 as a variety of patterns (e.g. a multi-helix pattern), or no pattern, may be substituted for the helical winding 112. The driving portion 110 may also be configured to advance into an instrumentation tube 50. Accordingly, the outside diameter of the driving portion 110 may be less than 1 inch, for example, the outside diameter of the driving portion 110 of the cable 100 may be about 0.27 inches.

The driving portion 110 may further include markings 116 on or in the cable 100 that may be tracked by a counter. The counter may determine how far a portion of the cable 100 has traveled to and/or from the drive system 300 based on the markings 116. This feature may be useful in the event an operator desires to know how far into the reactor pressure vessel 10 the cable 100 has traveled. This feature may also be useful in the event an operator desires to know how far into the loading/unloading area 2000 the cable has traveled. This feature may prevent or reduce system damage and down time. However, the invention is not limited to a cable 100 having the aforementioned markings as other devices may be used to track the position of the cable 100. For example, an encoding device may be coupled to the helical gear 330 of the drive mechanism 300 to relate a cable position as a function of the rotational movement of the gear 330 or to the motor 340 which may be used to drive the cable 100.

As shown in FIG. 4, the target portion 120 of the example cable 100 may include a plurality of irradiation targets 122 attached to a first end 114 (See FIG. 3) of the driving portion 110. The plurality of irradiation targets 122, may for example, include irradiation targets having an atomic weight of greater than 3. The plurality of irradiation targets 122, for example, may include a plurality of molybdenum pellets threaded by a wire-like or flexible cable material 124. The wire-like or flexible cable material 124 may also be made from the same material as the irradiation targets 122, thus, the wire-like or flexible cable material 124 may also be made from additional target material. As shown in FIG. 4, the irradiation targets 122 may be strung together in a manner resembling a string of pearls. Accordingly, the irradiation targets 122 may be strung so as to form a flexible, structure. In FIG. 4, sixteen irradiation targets 122 are shown, however, the invention is not limited thereto as any number of targets that may be strung together. The length of the target portion 120 may vary depending on a number of factors such as the material that is being irradiated, the size of the irradiation targets, the amount of radiation the target is expected to be exposed to, or the geometry of the instrument tubes 50. As an example, the target portion 120 may be up to 12 feet long.

It should be emphasized that an irradiation target is a target that is irradiated for the purpose of generating radioisotopes. Accordingly, sensors, which may be irradiated by a nuclear reactor and which may generate radioisotopcs, do not fall within the scope of term target as used herein since their purpose is to detect the state of the reactor rather than to generate radioisotopes.

Referring to FIGS. 3-4, the target portion 120 may include a first end cap 126 at a first end 127 of the target portion 120 and a second end cap 128 at a second end 129 of the target portion 120. The first end cap 126 of the target portion may be configured to attach to a first end 114 of the driving portion 110. The first end cap 126 of the target portion and the first end 114 of the driving portion 110 may form a quick connect/disconnect connection. For example, the first end cap 126 may include a hollow portion having internal threads 126A. The first end 114 of the driving portion 110 may include a structure 113 having external threads that may be configured to mesh with the internal threads 126A of the first end cap 126. Although the example connection illustrated in FIGS. 3 and 4 is described as a threaded connection, the invention is not limited thereto as one skilled in the art would recognize various other methods of connecting the target portion 120 of the cable 100 to the driving portion 110 of the cable 100.

Figure 5:
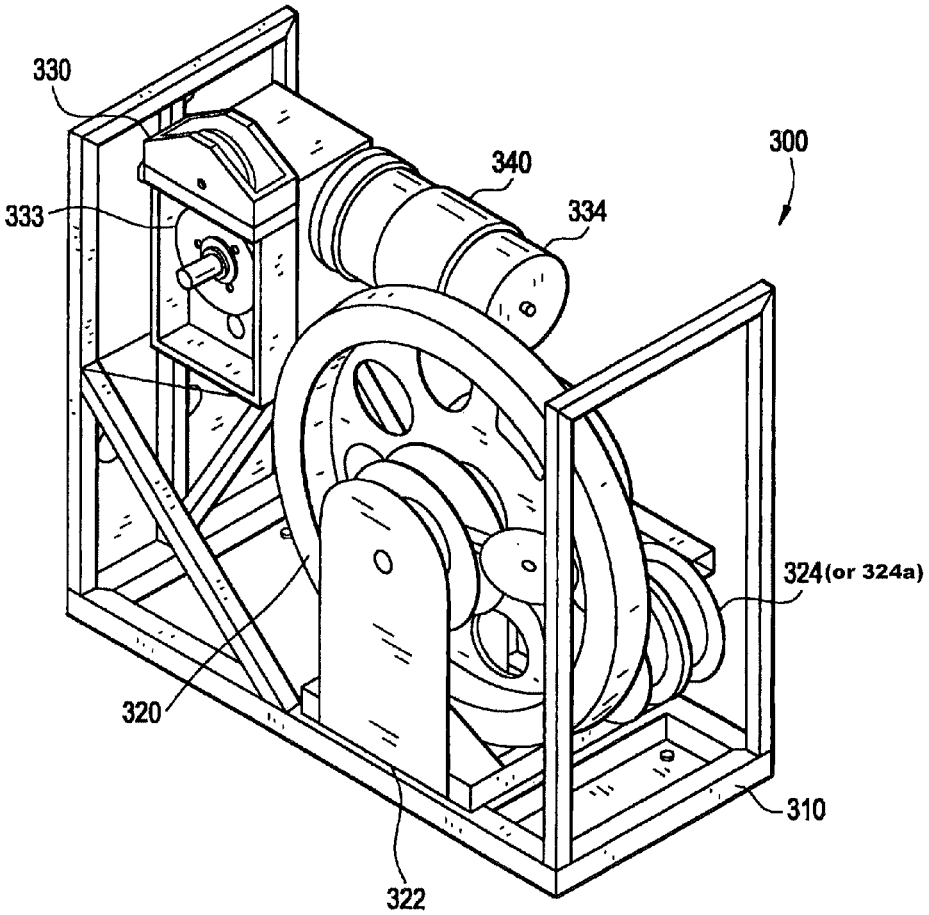
FIG. 5 is a view of a drive system for a cable driven isotope delivery system according to example embodiments.
Figure 6:
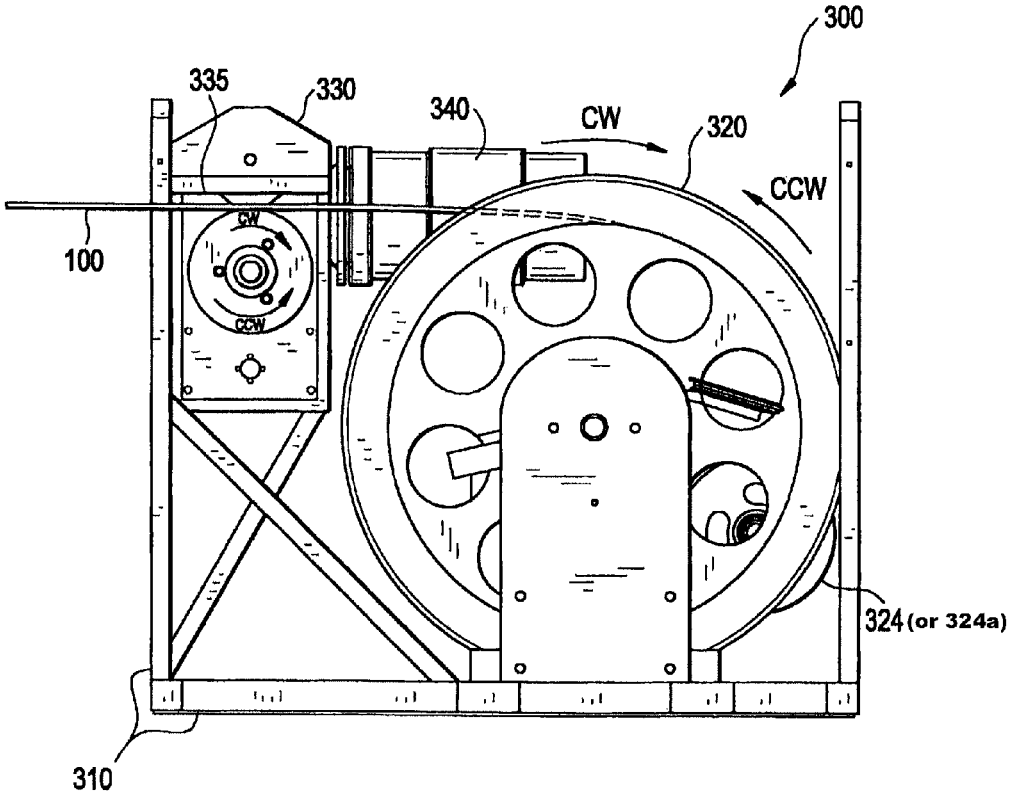
FIG. 6 is front view showing a gear reduction, worm drive system, with a helical gear meshing with helical winding of a cable according to example embodiments.

Referring to FIGS. 5-6, the drive system 300 of the cable driven isotope delivery system 1000 may include a framework 310 supporting a cable storage reel 320, a worm drive 330, and a motor 340 for driving the worm drive 330. The cable storage reel 320 may resemble a vertically oriented circular wheel or a drum like device around which the cable 100 may be wrapped. The cable storage reel 320 may include a cable storage reel shaft 322 through the center of the cable storage reel 320 to allow the cable storage reel 320 to rotate. The cable storage reel shaft 322 may be supported by sealed pillow block or other types of bearings (not shown). Accordingly, cable storage reel 320 may rotate in either a clockwise (CW) or in a counter clockwise (CCW) direction, as shown in FIG. 6.

The worm drive 330 may include a helical gear 333 with teeth 335 configured to mesh with the helical winding 112 of the cable 100. Thus, if the helical gear 333 rotates in the (CCW) direction, as shown in FIG. 6, the cable 100 may be unwound from the cable storage reel 320 and advanced away from the drive system 300. If the helical gear 333 rotates in the (CW) direction as shown in FIG. 6, the cable 100 may be pulled towards the drive system 300 to be stored back onto the cable storage reel 320.

The cable 100 may be wound on the cable storage reel 320. The cable 100 may also be partially supported by the helical gear 333. As one skilled in the art would readily recognize, a helical gear 333 has inclined and/or curved teeth. Accordingly, in this example of a drive system, the teeth 335 of the helical gear 333 may be configured to compliment the helical winding 112 on the outside of the driving portion 110 of the cable 100. Thus, the cable 100 may be moved towards or away from the drive system 300 by operating the worm drive 330 and the motor 340.

Figure 8:
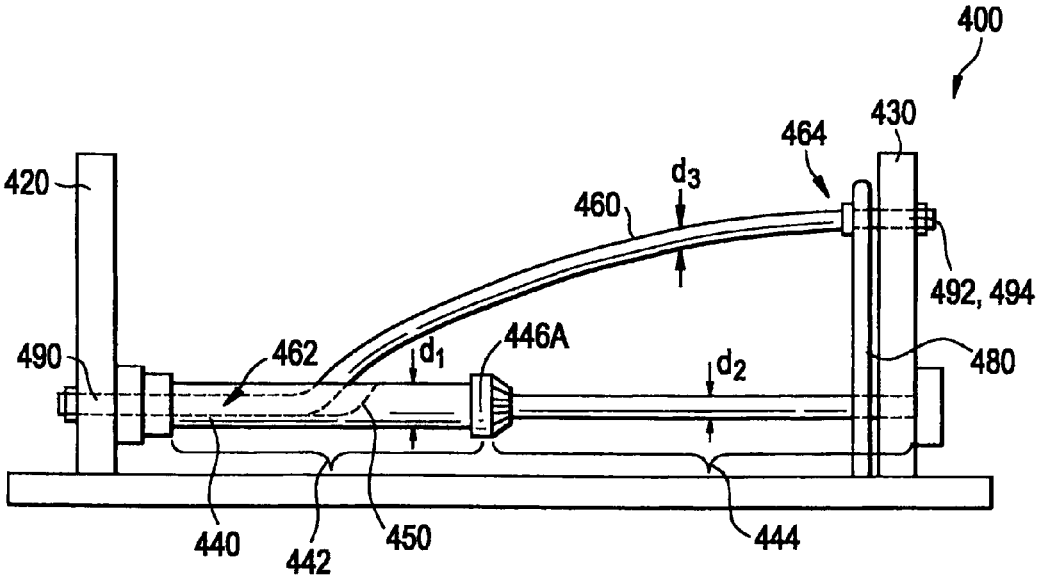
Figure 15:
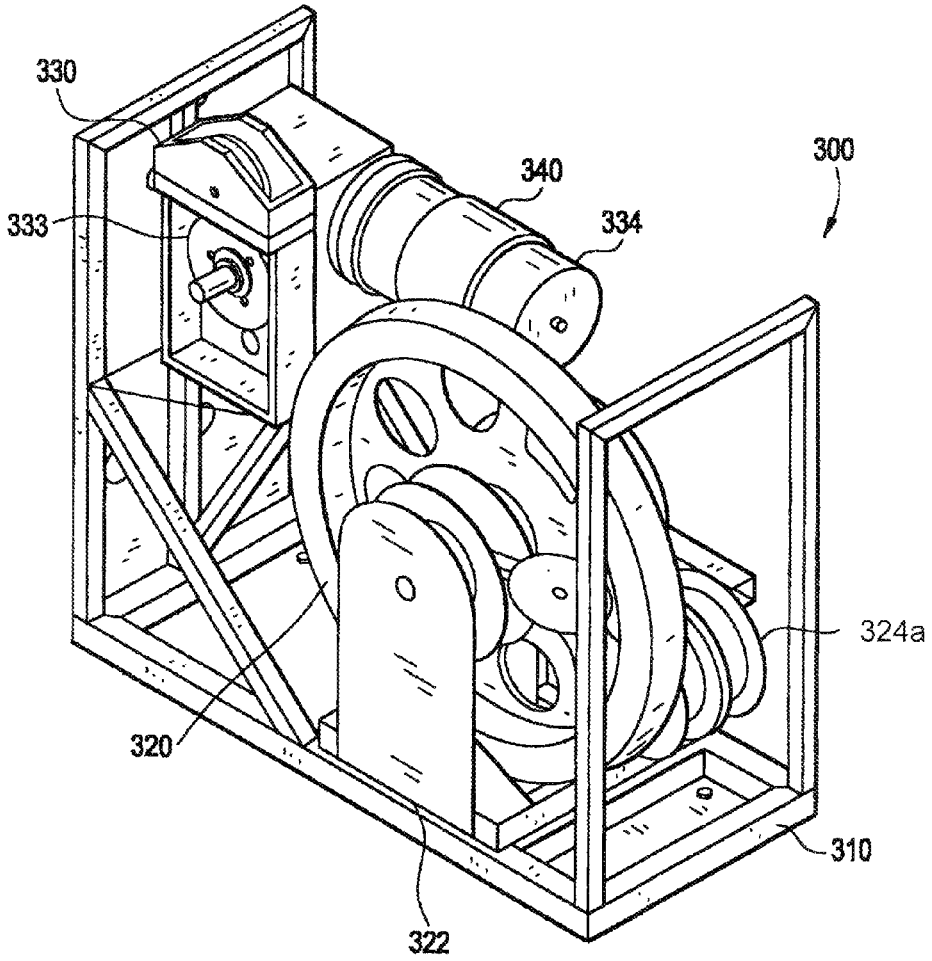
FIG. 15 is a view of a drive system for a cable driven isotope delivery system according to example embodiments.
Figure 16:
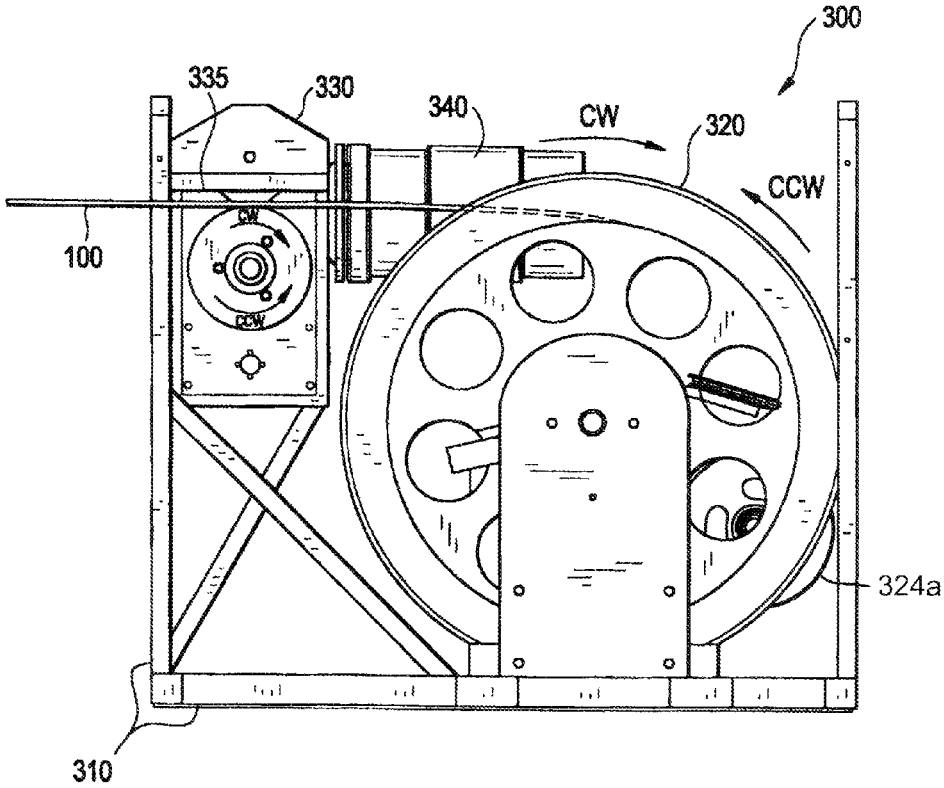
FIG. 16 is a front view showing a gear reduction, worm drive system, with a helical gear meshing with helical winding of a cable according to example embodiments.

The drive system 300 may further include a coil spring 324, or alternatively a counter weight 324*a* (see FIGS. 15 and 16, which are identical to FIGS. 5 and 6, respectively, but show counter weight 324*a* in place of coil spring 324) operatively connected to the cable storage reel 320. The coil spring 324 or counter weight 324*a* may be configured to bias the storage reel 320 to rotate in a clockwise direction ((CW) as shown in FIG. 8) thus keeping the cable 100 taut between the helical gear 333 and the cable storage reel 320 to reduce back-lash within the cable drive system 300. Additionally the coil spring 324 or counter weight 324*a* can serve as a safety back up system for the removal of the cable 100 from the reactor core 15 should the motor 340 fail after the target material has been position within the core 15 of the reactor.

Although the example drive system 300 is illustrated as having a worm drive 330 to move the cable 100 to or from the drive system 300, the invention is not limited thereto. For example, a pair of pinch rollers may be utilized instead of a helical gear 333 to pinch and move the cable 100 to or from the drive system 300. As another example, a hand crank may be attached to the helical gear 333 or cable storage reel shaft 322 to provide for a manual control method of inserting and/or the extraction of the cable 100, (not pictured).

Figure 7:
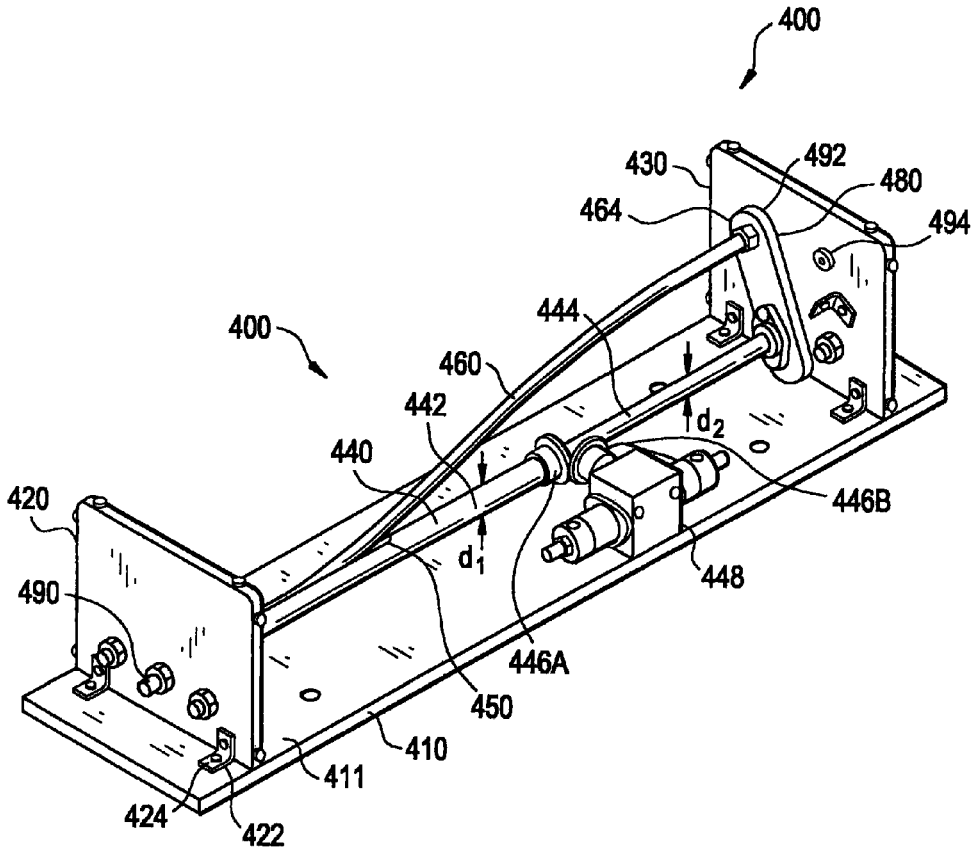
FIGS. 7-8 are views of a cable guide according to example embodiments.

Referring to FIGS. 2, 7, and 8, the first guide 400 may be configured to guide the cable 100 to either a loading/unloading area 2000 or the instrument tubes 50 of the nuclear reactor pressure vessel 10. The first guide 400 may include a horizontal base plate 410, a first vertical plate 420 near a first end of the horizontal base plate 410, a second vertical plate 430 near a second end of the horizontal base plate 410, a multi-diameter shaft 440 between the first vertical plate 420 and the second vertical plate 430, a set of bevel gears 446A and 446B, a cable guide tube 460, and a rotary gear-driven cylinder 448 to rotate the multi-diameter shaft 440.

Referring to FIG. 7, the horizontal rectangular base plate 410 may have a relatively long length in a first horizontal direction; a relatively short length in a second horizontal direction, and a thickness in a vertical direction. The first vertical plate 420 and the second vertical plate 430 may be attached to a containment structure 411 of the horizontal base plate 410. As shown in FIGS. 7 and 8, the first and second vertical plates 420 and 430 may be oriented so that thicknesses of the first and second vertical plates 420 and 430 extend within the first horizontal direction of the base plate 410. The first and second vertical plates 420 and 430 may be attached to the horizontal base plate 410 using, for example, machine brackets 422 and screws 424. However, the example first guide 400 is not limited thereto. For example as an alternate method of attachment, the first and second vertical plates 420 and 430 may, be welded to the base plate 410.

The first vertical plate 420 may include a single cable entry point 490 through which the cable 100 may pass and the second vertical plate 430 may include at least two cable exit points 492 and 494 one of which directs the cable 100 to the loading/unloading area 2000 and the other of the cable exit points 492 and 494 to the reactor pressure vessel 10. For example, cable exit point 492 may direct the cable 100 to the loading/unloading area 2000 and cable exit point 494 may direct the cable 100 towards the reactor pressure vessel 10.

A multi-diameter shaft 440 may be provided between the first vertical plate 420 and the second vertical plate 430. As shown in FIGS. 7-8, the multi-diameter shaft 440 may have a first portion 442 having a first diameter $d_1$ near the first vertical plate 420 and a second portion 444 having a second diameter $d_2$ near the second vertical plate 430. A bevel gear 446A may be provided in the multi-diameter shaft 440 at the interface between the first portion 442 and the second portion 444. The ends of the multi-diameter shaft 440 may be rotationally supported by the first and second vertical plates 420 and 430 so that the multi-diameter shaft 440 is easily rotatable about its axis.

The cable guide tube 460 may include a first end 462 supported by the first portion 442 of the multi-diameter shaft 440. The cable guide tube 460 may also include a second end 464 supported by a crank 480 which in turn is rigidly connected to the second portion 444 of the multi-diameter shaft 440. As shown in FIGS. 7-8, the first portion 442 of the multi-diameter shaft 440 may include a slot 450 to accommodate the cable guide tube 460 so that the first end 462 of the cable guide tube 460 may be aligned with the first cable entry point 490 to receive the cable 100.

The rotary cylinder 448 may be configured to rotate a bevel gear 446B. For example, the rotary cylinder 448 may be attached to bevel gear 446B having teeth configured to mesh with the teeth 335 if the bevel gear 446A of the multi-diameter shaft 440. Accordingly, the rotary cylinder 448 may operate to rotate the bevel gear 4461 which in turn rotates the bevel gear 446A attached to the multi-diameter shaft 440 which thereby rotates the multi-diameter shaft 440 supported by the vertical plates 420 and 430. Because the cable guide tube 460 is attached to the multi-diameter shaft 440, the rotation of the multi-diameter shaft 440 causes the cable guide tube 460 to move thereby allowing for alignment of the second end 464 of the cable guide tube 460 with either of the cable exit points 492, 494. Therefore, an operator may configure the first guide 400 to direct the cable 100 to one of the cable exit points 492, 494 by operating the rotary cylinder 448. In accordance with example embodiments, the operation of the rotary cylinder 448 may be controlled remotely by the operator.

Figure 9:
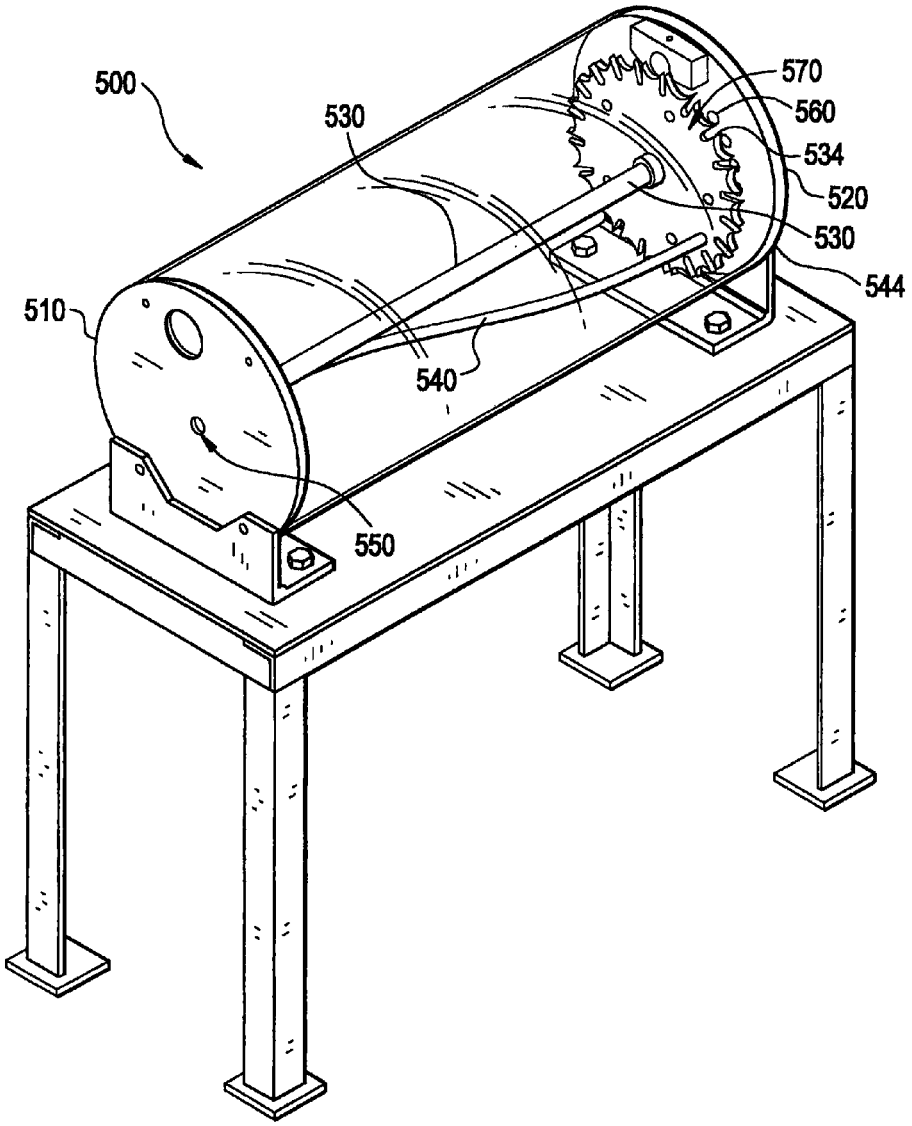
FIGS. 9-10 are views of an additional cable guide according to example embodiments.
Figure 10:
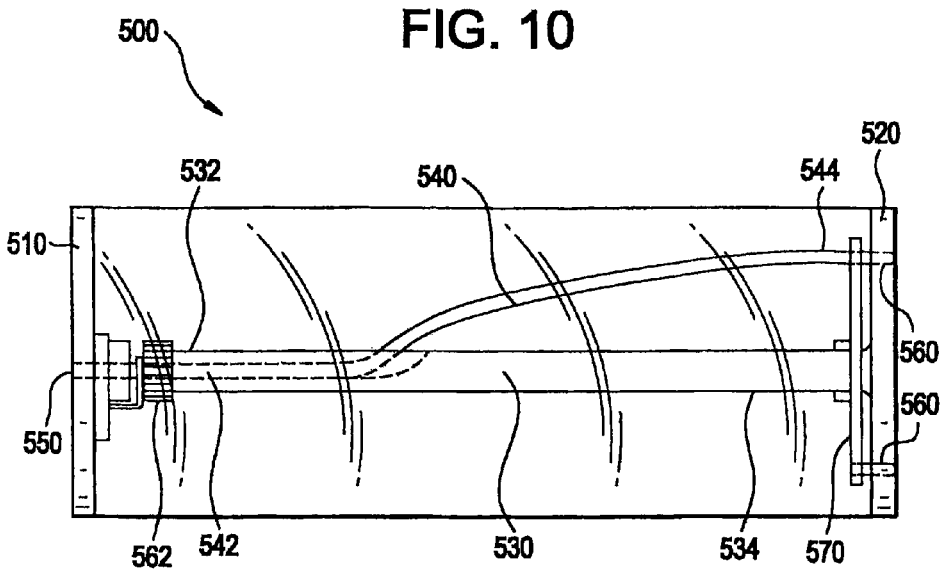

Referring to FIGS. 9 and 10, the second guide 500 may be configured to guide the cable 100 to any one of a number of instrumentation tubes 50 in the nuclear reactor pressure vessel 10. As shown in FIGS. 9 and 10, the second guide 500 may be cylindrically shaped having a first circular end plate 510 associated with one of the cylindrically shaped second guide 500 and a second circular end plate 520 associated with another end of the cylindrically shaped second guide 500.

The first circular end plate 510 may have a cable entry point 550 configured to receive the cable 100. As shown in FIGS. 9 & 10, the cable entry point 550 may be located in the center of the first circular end plate 510. The second circular end plate 520 may include a plurality of cable exit points 560 which may be connected to any one of a number of instrumentation tubes 50 located within the reactor's core 15. The cable exit points 560 may be arranged in a circular pattern on the second circular end plate 520 such that the center of the circular pattern is coincident with the center of the second circular end plate 520.

The second guide 500 may also include a shaft 530 having a first end 532 of the shaft 530 substantially supported by the first circular end plate 510 and a second end 534 of the shaft 530 substantially supported by the second circular end plate 520. As shown in FIG. 10, the first end 532 of the shaft 530 may include rotation gear 562 that may be connected to a motor (not shown) so that the shaft 530 may be rotated via the operation of the motor. Additionally, the second end 534 of the shaft 530 may be attached to a locking gear 570 that may rotate as the shaft 530 rotates about its center.

The second guide 500 may further include a cable guide tube 540 configured to receive the cable 100. As shown in FIG. 10, a first end 532 of the shaft 530 may be slotted to accommodate a first end 542 of the cable guide tube 540 so that the first end 542 of the cable guide tube 540 may be aligned with the cable entry point 550 to receive the cable 100. A second end 544 of the cable guide tube 540 may be attached to the locking gear 570 so that the second end 544 of the cable guide tube 540 may be aligned with at least one of the cable exit points 560.

As discussed above, a motor and/or a manual hand-cranking device (not shown) may be provided to rotate the rotation gear 562 thereby rotating the shaft 530. The rotation of the shaft 530, in turn, causes the cable guide tube 540 to rotate thereby allowing for alignment of the second end 544 of the cable guide tube 540 with any one of the cable exit points 560. Therefore, an operator may configure the second guide 500 to guide the cable 100 to any of the multi-cable exit points 560 by operating the motor and/or the manual hand-cranking device (not shown) to rotate the cable guide tube 540 into a desired position. Accordingly, the operator may direct the cable 100 to a desired instrumentation tube 50 within the reactor pressure vessel 10. In accordance with example embodiments, the operation of the motor may be controlled remotely by the operator.

As illustrated in FIG. 2, the cable driven isotope delivery system 1000 may include a cable 100, tubing 200*a*, 200*b*, 200*c*, 200*d*, a drive system 300, a first guide 400, and a second guide 500. The tubing 200*a* may be provided between the drive system 300 and the first guide 400. The tubing 200*c* may be provided between the first guide 400 and the second guide 500. The tubing 200*d* may be provided between the second guide 500 and the entrance within the reactor pressure vessel 10 and then onward into an instrumentation tube 50. The tubing 200*b* may be provided between the first guide 400 and the loading/unloading area 2000. The tubing 200*a*. 200*b*, 200*c*, and 200*d* may be provided to support and guide the cable 100, accordingly, the tubing 200*a*, 200*b*, 200*c*, and 200*d* may be configured to have a relatively low coefficient of friction and be resistant to corrosion.

Figure 11:
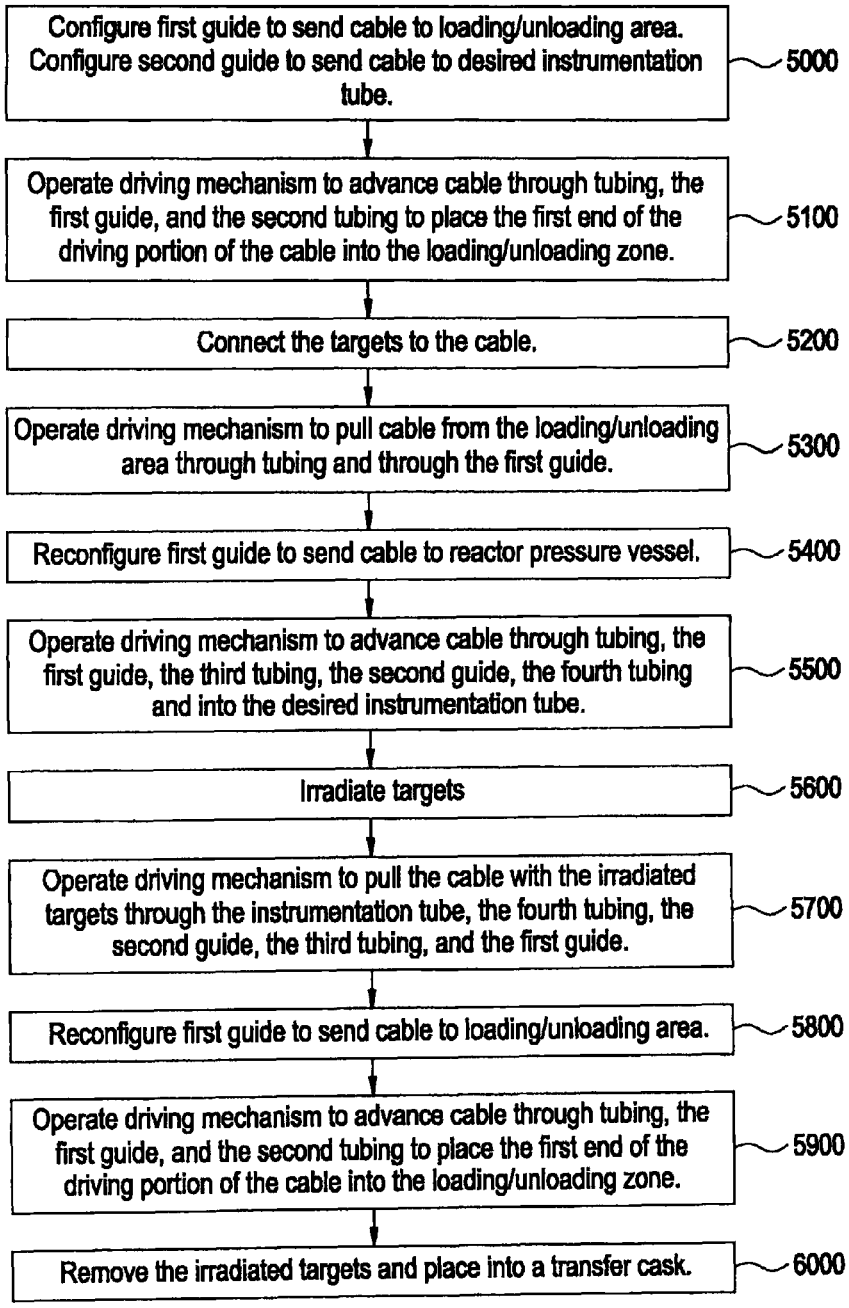
FIG. 11 is a flowchart illustrating a method of irradiating a target according to example embodiments.

In consideration of the described cable driven isotope delivery system 1000, a method of irradiating a target is described with reference to FIGS. 1-10 when using a flowchart see FIG. 11. The example method of irradiating a target is not limited to use with example embodiments of the cable driven isotope system described above nor is the method limited to the operations recited below. Furthermore, the example method of irradiating a target does not limit example embodiments of the cable driven isotope system. Rather, the example method of irradiating a target is provided merely for exemplary purposes and should not be construed as limiting the invention.

Initially, an operator may configure the first guide 400 and the second guide 500 so that the cable is advanced to the appropriate destination. For example, as shown in operation 5000, an operator may configure the first guide 400 to send the cable 100 to the loading/unloading area 2000 and may configure the second guide 500 to send the cable 100 to the desired instrumentation tube 50. For example, the operator may configure first guide 400 to send the cable 100 to the loading/unloading area 2000 by controlling the rotary cylinder 448 to rotate the multi-diameter shaft 440 to position the cable guide tube 460 in the proper orientation. For example, the operator may control the rotary cylinder 448 to rotate the multi-diameter shaft 440 to rotate the cable guide tube 460 so that the second end 464 of the cable guide tube 460 is aligned with a cable exit point 492 which may connect to tubing 200*b* leading to the loading/unloading area 2000. Similarly, the operator may configure the second guide 500 to send the cable 100 to desired instrumentation tube 50 by controlling a motor and/or a manual hand-cranking device (not shown) in the second guide 500 to rotate the cable guide tube 540 in the proper orientation. For example, the operator may control the motor and/or manual hand-cranking device to rotate the shaft 530 so that the second end 544 of the cable guide tube 540 is aligned with a desired cable exit point 560 which may connect to tubing 200*d* leading to the desired instrumentation tube 50.

After configuring the first and second guides 400 and 500, an operator may operate the driving system 300 to advance the cable through tubing 200*a*, the first guide 400, and the second tubing 200*b* to place the first end 114 of the driving portion 110 of the cable 100 into the loading/unloading area 2000 as described in operation 5100. During this operation, the operator may advance the cable 100 by controlling the worm gear 330 to rotate in a counter clockwise direction (CCW) as shown in FIG. 6. The location of the first end 114 of the driving portion 110 of the cable 100 may be tracked by the operator via markings 116 on the cable 100. In the alternative, the position of the first end 114 of the driving portion 110 of the cable 100 may be known from information collected from an encoder 334 that may be connected to the worm drive 330.

After the cable 100 has been positioned in the loading/unloading area 2000, the operator may stop the worm drive 330 from rotating thereby stopping the movement of the cable 100. The irradiation targets 122 may then be connected to the cable 100 (operation 5200). The irradiation targets 122 may be strung together by a wire-like material 124 as shown in FIG. 4 that may be connected to the first end 114 of the driving portion 110 of the cable 100.

After the irradiation targets 122 are connected to the cable 100, an operator may operate the drive system 300 to pull the cable 100 from the loading/unloading area 2000 through the tubing 200*b* and through the first guide 400 (operation 5300). During this operation, the operator may control the worm drive 330 to rotate the helical gear 333 in a clockwise direction (CW), as shown in FIG. 6, thus pulling the cable 100 from the loading/unloading area 2000. The location of the cable 100 may be tracked by the operator via the markings 116 on the cable 100. In the alternative, the position of the first end 114 of the driving portion 110 of the cable 100 may be known from information collected from an encoder 334 that may be connected to the helical gear 333.

After the cable 100, including the irradiation targets 122, is pulled through the first guide 400, the operator may stop the worm drive 330 from rotating thereby stopping the movement of the cable 100. The operator may then reconfigure the first guide 400 to send the cable 100 with the irradiation targets 122 to the reactor pressure vessel 10 (operation 5400). The first guide 400 may be reconfigured by controlling the rotary cylinder 448 to rotate the multi-diameter shaft 440 to position the cable guide tube 460 in the proper orientation. For example, the operator may control the rotary cylinder 448 to rotate the multi-diameter shaft 440 to rotate the cable guide tube 460 so that the second end 464 of the cable guide tube 460 is aligned with a cable exit point 494 that may connect to tubing 200*c* leading to the second guide 500.

After the first guide is reconfigured, the operator may advance the cable 100 with the irradiation targets 122 through the third tubing 200*c*, the second guide 500, will require an operator to configure the second guide 500 so as to allow the cable 100 with targets 122 to advance within the fourth tubing 200*d*, and into the desired instrumentation tube 50 (operation 5500). During this operation, the operator may advance the cable 100 by controlling the worm drive 330 to rotate the helical gear 333 in a counter clockwise direction (CCW) as shown in FIG. 6. The location of the first end 114 of the driving portion 110 of the cable 100 may be tracked by the operator via markings 116 on the cable 100. In the alternative, the position of the first end 114 of the driving portion 10 of the cable 100 may be known from information collected from an encoder 334 that may be connected to the helical gear 333.

After the cable 100 with the irradiation targets 122 has been advanced to the appropriate location within the instrumentation tube 50, the operator may stop the worm drive 330 from rotating thus holding the irradiation targets 122 in the instrumentation tube 50. At this point, the targets may be irradiated for the proper time (operation 5600). After the irradiation targets 122 have been irradiated the operator may operate the drive system 300 to retract the cable 100 with the irradiated targets 122 through the instrumentation tube 50, the fourth tubing 200*d*, the second guide 500, the third tubing 200*c* and the first guide 400 (operation 5700). For example, the operator may control the worm drive 330 to rotate the helical gear 333 clockwise (CW) as shown in FIG. 6 until the cable 100 with the irradiation targets 122 is drawn through the first guide 400. During this operation, the operator may track the location of the irradiation targets 122 using the markings 116 on the cable 100. In the alternative, the operator may utilize information from an encoder 334 connected to the helical gear 333 to track the location of the irradiation targets 122.

After the irradiation targets 122 have been irradiated and drawn back into the first guide 400 via an operation of the drive system 300, the operator may stop the worm drive 330 from rotating thereby stopping the movement of the cable 100 with the attached target portion 120. An operator may then reconfigure the first guide 400 so that the cable 100 may be advanced to the loading/unloading area 2000 (operation 5800). For example, the operator may reconfigure first guide 400 to send the cable 100 to the loading/unloading area 2000 by controlling the rotary cylinder 448 to rotate the multi-diameter shaft 440 to position the cable guide tube 460 in the proper orientation. For example, the operator may control the rotary cylinder 448 to rotate the multi-diameter shaft 440 to rotate the cable guide tube 460 so that the second end 464 of the cable guide tube 460 is aligned with a cable exit point 492 and 494 which may connect to tubing 200*b* leading to the loading/unloading area 2000.

After reconfiguring the first guide 400, an operator may operate the drive system 300 to advance the cable 100 through the first guide 400, and the second tubing 200*b* to place the first end 114 of the driving portion 110 of the cable 100 and the irradiation targets 122 into the loading/unloading area 2000 as described in operation 5900. During this operation, the operator may advance the cable 100 by controlling the worm drive 330 to rotate the helical gear 333 in a counter clockwise direction (CCW) as shown in FIG. 6. The location of the irradiation targets 122 connected to the driving portion 110 of the cable 100 may be tracked by the operator via the markings 116 on the cable 100. In the alternative, the position of the first end 114 of the driving portion 110 of the cable 100 may be known from information collected from an encoder 334 that may be connected to the helical gear 333.

Once in the loading/unloading area 2000, the irradiation targets 122 may be removed from the cable 100 and stored in a transfer cask (operation 6000). In accordance with an example embodiment of the present invention, the transfer cask may be made of lead, tungsten, and/or depleted uranium in order to adequately shield the irradiated targets from personnel. The transfer cask could also be configured to fit into a conventional shipping cask. The loading/unloading area could be configured to allow the transfer cask to be accessible by a lifting mechanism to facilitate movement of the transfer cask. The transfer cask may also be configured with a remote lid so that the transfer cask may be sealed remotely. Additionally, the attachment and detachment of irradiation targets 122 may be facilitated by the use of camera system which may be placed in the loading/unloading area 2000 to allow an operator to visually inspect the equipment during operation.

The above method is only illustrative of one method of using the cable driven isotope delivery system 1000, however, the invention is not limited thereto. For example, an operator may configure the second guide 500 at any time prior to the cable 100 entering the second guide 500. As another example, the system may be automated and controlled by a computer aided programming system.

Although the above system may be implemented as an entirely new system within many existing or future nuclear power plants, the inventive concept is not limited thereto. For example, the inventive concept may be used in conjunction with conventional systems that are already configured with a tubing systems leading to an instrumentation tube 50.

Figure 12:
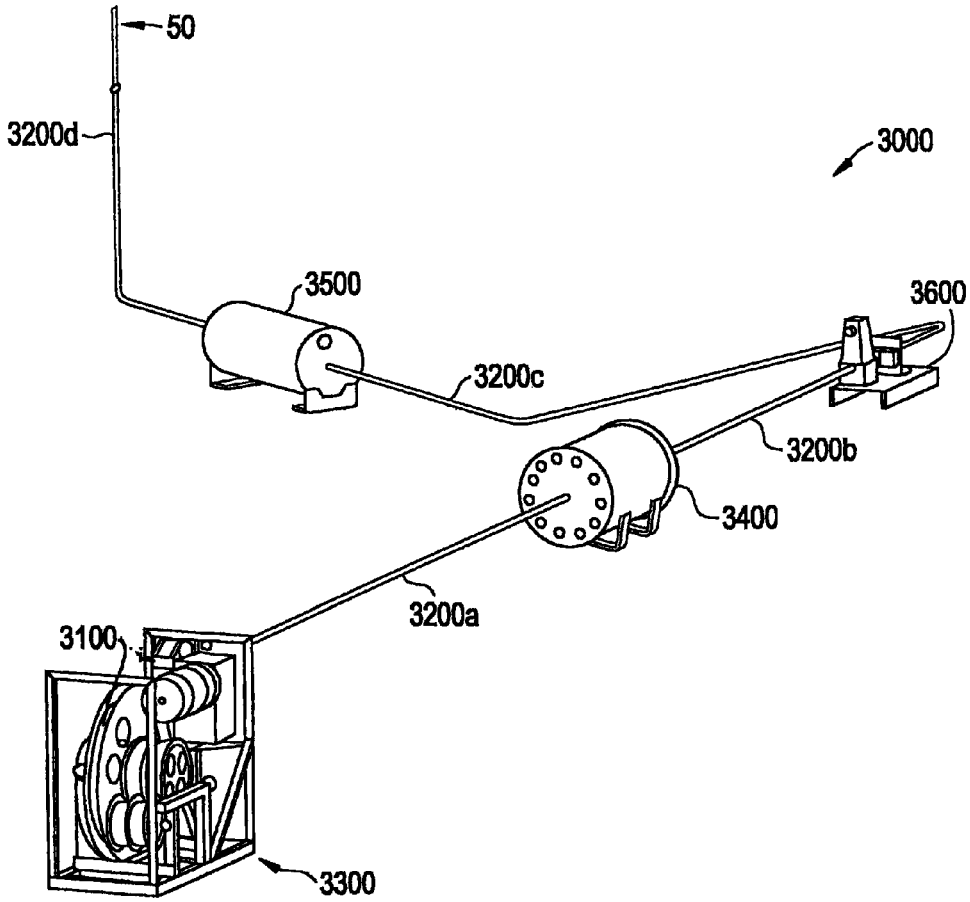
FIG. 12 Conventional Art
FIG. 12 is a view of a conventional Transverse-In-Probe system.

For example, some conventional power plants use a Transverse In-core Probe (TIP) system 3000 to monitor neutron thermal flux within a reactor. A conventional TIP system 3000 is illustrated in FIG. 12. As shown in FIG. 12, the TIP system 3000 may include a drive mechanism 3300 for driving a cable 3100, tubing 3200*a* between the drive system 3300 and a chamber shield 3400, tubing 3200*b* between the chamber shield 3400 and valves 3600, tubing 3200*c* between the valves 3600 and a guide 3500, and tubing 3200*d* between the second guide 3500 and an instrument tube 50. The cable 3100 may be similar to the cable 100 described above except that the target portion 120 of cable 100 is replaced with a TIP sensor. The drive mechanism 3300 used with a conventional TIP system 3000 may be structurally and operationally similar to the drive system 300 described above. Accordingly, a description thereof is omitted for brevity. The guide 3500 of a conventional TIP system 3000 may guide the TIP sensor to a desired instrument tube 50. The guide 3500 may be structurally and operationally similar to the second guide 500 described above, accordingly, a description of guide 3500 is omitted for the sake of brevity. The chamber shield 3400 is well known in the art and resembles a barrel filled with lead pellets. The chamber shield 3400 is used to store the TIP sensor when the TIP sensor is not utilized in the reactor pressure vessel 10. The valves 3600 are a safety feature utilized with the TIP system 3000.

Because the TIP system 3000 already includes a tubing system (3200*a*, 3200*b*, 3200*c*, and 3200*d*) and a guide (3500) for guiding a cable 100 into an instrument tube 50, the inventive concept may be applied with an existing TIP system 3000.

Figure 13:
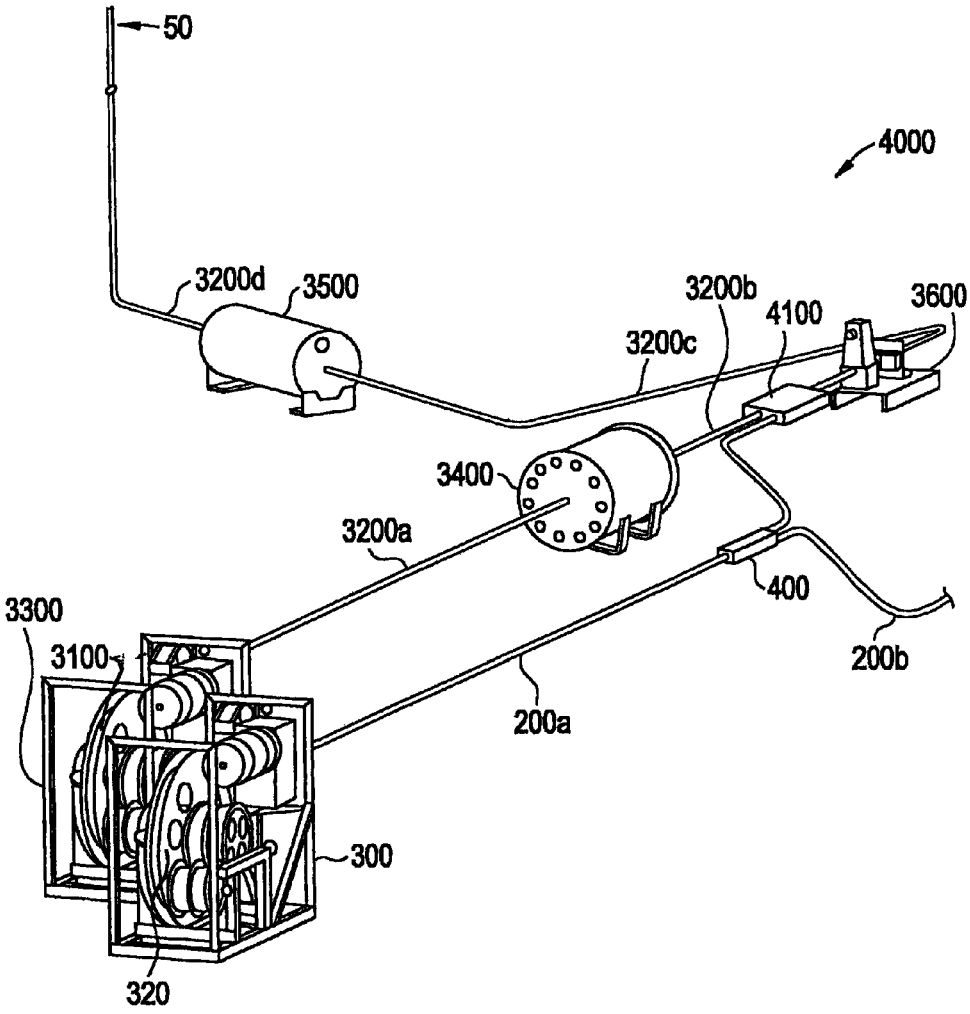
FIG. 13 is a view of a modified transverse-In-Probe system according to example embodiments.

FIG. 13 illustrates a modified TIP system 4000 in which the inventive concept may be applied. As shown in FIG. 13, the modified TIP system 4000 is substantially similar to the TIP system 3000 illustrated in FIG. 13 except that a guide 4100 is introduced between the chamber shield wall 3400 and the valves 3600 of the conventional TIP system 3000. The guide 4100 may serve as an access point for introducing a cable, for example, cable 100, into the TIP system 3000 when the present TIP system 3000 is not in use. As shown in FIG. 13, the drive system 300 of the cable driven isotope system 1000 may be placed in parallel with the drive system 3300 of the TIP system 3000. The drive system 300 may include the cable storage reel 320 in which the cable 100 may be wrapped. The drive system 300 may also include the worm drive 330 and helical gear 333 as described previously for moving the cable 100 towards or away from the drive system 300. As described previously, a tube 200*a* may extend from the drive system 300 to the guide 400 which may direct the cable 100 to a desired location. For example, an operator may configure first guide 400 to direct the cable 100 to a loading/unloading area 2000 via tubing 200*b* by controlling the rotary cylinder 448 of the first guide 400 to align the second end 464 of the cable guide tube 460 with the appropriate exit point, for example, exit point 492 and 494. However, unlike the previous embodiment, rather than having an exit point which may direct the cable 100 to second guide 500, the first guide 400 in this embodiment may be configured to direct the cable 100 to the guide 4100 instead. Accordingly, the first guide 400 of this embodiment may guide the cable 100 into the present employed TIP system 3000 tubing via the guide 4100.

Figure 14:
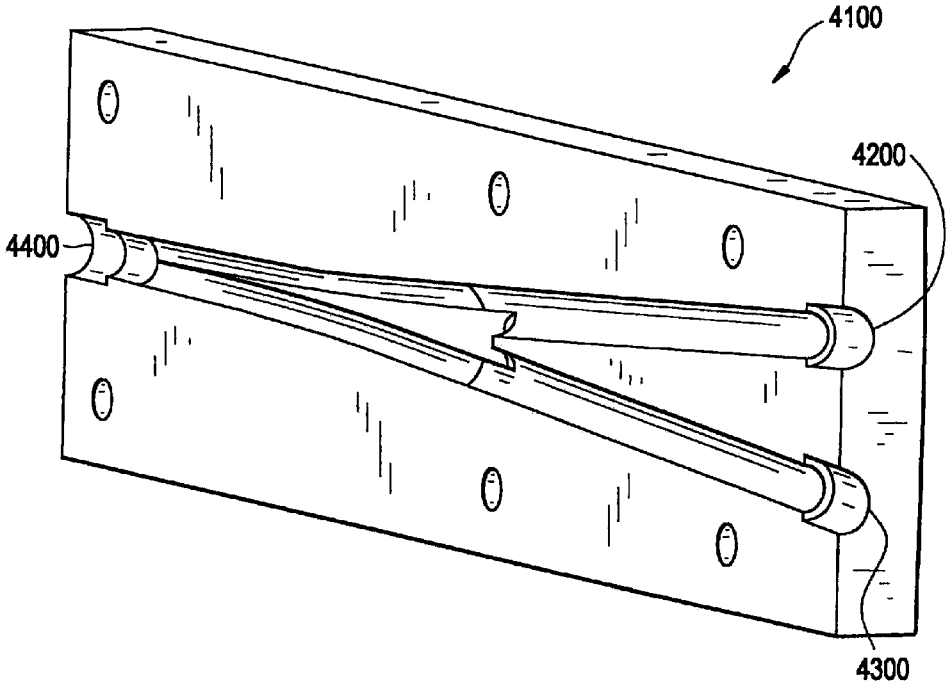
FIG. 14 is a view of a wye guide according to example embodiments.

A cross-section of the guide 4100 is illustrated in FIG. 14. As shown in FIG. 14, the guide may resemble a WYE having two entry points 4200 and 4300 and one exit point 4400. The entry point 4200 may be configured to receive the cable 100 and the entry point 4300 may be configured to receive the cable 3100 that would normally employ the usage of the TIP system 3000. The exit point 4400 may allow either the TIP system's cable 3100 or the cable 100 as used by the cable driven isotope delivery system 1000 to exit the guide 4100 thus allowing an entrance within the tubing 3200-B2 and into the conventional TIP tubing 3200*c*, the conventional TIP guide 3500, and the conventional TIP tubing 3200*d* to enter within the instrument tubes 50.

It should be obvious to one skilled in the art that if the cable driven isotope system 1000 is to be used with a conventional TIP system 3000, the cable 100 should be sized to function with the existing tubing. In conventional TIP systems 3000, the inner diameter of the tubing may be approximately 0.27 inches. Accordingly, the cable 100 may be sized so that dimensions transverse to the cable 100 do not exceed 0.27 inches.

Additionally, it should be obvious to one skilled in the art that a system, such as the TIP system 3000 may be modified in other ways which fall within the scope of the present invention. For example, the guide 4100 may be installed between the valves 3600 and the guide 3500 rather than the between the shield 3400 and the valves 3600. Additionally, the other system known to those skilled in the art may be similarly modified rather than the conventional TIP system 3000.

While example embodiments have been particularly shown and described with reference to example embodiments thereof, it will be understood by those of ordinary skill in the art that various changes in form and details may be made therein without departing from the spirit and scope of the following claims.

What is claimed is:

1. An isotope delivery system, comprising:

a cable including at least one target for irradiation, the at least one target being transformable into a metastable isotope when exposed to a neutron flux of a nuclear reactor;

a drive system configured to move the cable; and a first guide configured to receive the cable from an upstream location, and selectively guide the cable to and from a loading area in a first downstream location and to and from the nuclear reactor in a second downstream location, the loading area being configured to selectively accept the cable into the isotope delivery system and discharge the cable from the isotope delivery system, wherein the target is made from one of a molybdenum metal and enriched molybdenum-98.

2. The system of claim 1, wherein the cable includes a driving portion and a target portion, the target portion including the at least one target.

3. The system of claim 2, wherein the driving portion of the cable is configured to include a helical winding.

4. The system of claim 3, wherein the drive system includes a device to engage the helical winding to move the cable towards the nuclear reactor.

5. The system of claim 2, wherein the target portion includes a plurality of targets threaded by a wire material.

6. The system of claim 5, wherein the wire material includes target material with an atomic weight greater than 3 and the plurality of targets is a plurality of targets having an atomic weight greater than 3.

7. The system of claim 5, wherein a first end of the target portion is attached to an end of the driving portion.

8. The system of claim 7, wherein the target portion includes a cap at the first end to attach to the end of the driving portion and a cap at a second end configured to navigate the target portion to the nuclear reactor.

9. The system of claim 1, wherein the drive system includes a reel configured to wrap the cable.

10. The system of claim 9, wherein the drive system includes a device attached to the reel to rotate the reel thereby causing the reel to pull and wrap the cable around the reel.

11. The system of claim 10, wherein the device is a spring or counter weight.

12. The system of claim 10, wherein the drive system includes a second device to push the cable towards the nuclear reactor thereby unwrapping the cable from the reel.

13. The system of claim 12, wherein the second device is a worm drive with a helical gear on an output shaft.

14. The system of claim 1, further comprising:

a second guide between the first guide and the nuclear reactor to guide the cable into the nuclear reactor;

a third guide between the first guide and the second guide; and tubing between the nuclear reactor and the second guide, between the second guide and the third guide, between the first guide and the third guide, between the first guide and the drive system, and between the loading area and the first guide, to support and guide the cable.

15. The system of claim 14, further comprising:

a transfer cask in the loading area to receive the target.

16. The system of claim 14, further comprising:

a camera in the loading area.

* * * * *